United States Patent [19]

Lindermeir et al.

[11] Patent Number: 5,052,622

[45] Date of Patent: Oct. 1, 1991

[54] SPRINKLER

[75] Inventors: Wolfgang Lindermeir, Untermarchtal; Franz Lopic, Nersingen; Johann Katzer, Neu-Ulm; Johann Schaeffer, Laupheim; Christian Stephany, Ulm; Roland Sauer, Ulm-Goegglingen, all of Fed. Rep. of Germany

[73] Assignee: Gardena Kress & Kastner GmbH, Fed. Rep. of Germany

[21] Appl. No.: 409,802

[22] Filed: Sep. 20, 1989

[30] Foreign Application Priority Data

Oct. 6, 1988 [DE] Fed. Rep. of Germany ..... 3833983

[51] Int. Cl.[5] ..... B05B 3/16; B05B 1/16

[52] U.S. Cl. ..... 239/242; 239/551; 239/562

[58] Field of Search ..... 239/240, 242, 551, 562, 239/600, DIG. 19

[56] References Cited

U.S. PATENT DOCUMENTS

| | | | |
|---|---|---|---|
| 1,517,664 | 12/1924 | Bergquist | 239/242 |
| 2,197,231 | 4/1940 | Walker | 239/551 |
| 2,631,058 | 3/1953 | Ingham et al. | 239/242 X |
| 2,673,122 | 3/1954 | Wehner | 239/242 |
| 2,952,413 | 9/1960 | Jepson | 239/242 |
| 3,160,348 | 12/1964 | Hunter | 239/242 X |
| 3,332,624 | 7/1967 | Rinkewich | 239/242 |
| 3,423,024 | 1/1969 | Morawetz | 239/242 |
| 3,827,637 | 8/1974 | Stephany et al. | 239/242 |

FOREIGN PATENT DOCUMENTS

| | | | |
|---|---|---|---|
| 536769 | 10/1931 | Fed. Rep. of Germany . | |
| 1926735 | 12/1970 | Fed. Rep. of Germany . | |
| 7115718 | 4/1971 | Fed. Rep. of Germany . | |
| 1912315 | 5/1971 | Fed. Rep. of Germany . | |
| 2444664 | 3/1975 | Fed. Rep. of Germany . | |
| 2248065 | 6/1977 | Fed. Rep. of Germany . | |
| 2112881 | 6/1972 | France . | |
| 2135012 | 12/1972 | France | 239/242 |
| 2201028 | 4/1974 | France . | |

*Primary Examiner*—Andres Kashnikow
*Assistant Examiner*—William Grant
*Attorney, Agent, or Firm*—Eckert Seamans Cherin & Mellott

[57] ABSTRACT

In a sprinkler (1), the water distributors (10) for supplying the spray nozzles (13, 14, 15) is formed by a separate main channel (15) inserted in a spray nozzle casing (2) and having relatively small flow cross-sections compared with the casing cross-sections, which is also constructed in one piece with the spray nozzles (13, 14, 15), so that the spray nozzle casing (2) does not have to be used for water distribution purposes and can instead merely serve as a support casing. Of the spray nozzles arranged in a row, those which are located at the end of the row can be individually manually disconnected with separate check valves (36), so that in simple manner it is possible to adjust the width of the exiting water curtain within certain limits.

30 Claims, 4 Drawing Sheets

SPRINKLER

BACKGROUND OF THE INVENTION

1. Field of the Invention

The invention relates to a sprinkler, such as is e.g. used as a portable or stationary means for sprinkling or watering lawns, flowerbeds, etc. For this purpose the sprinkler has spray nozzles, which are e.g. provided in at least one row on a nozzle carrier. The nozzle carrier, which can be formed by a curved pipe section or the like, is preferably constructed as a casing with different internal and/or external cross-sections and has a water distributor for supplying the water to the spray nozzles.

2. Prior Art

German Patent 19 12 315 discloses a sprinkler in which the spray nozzle casing over at least part of its length and substantially over its entire internal cross-section forms the associated part of the water distributor, so that in operation the casing is substantially completely filled, in pressurized manner with water and said water passes directly from the casing into the spray nozzles, which are formed by nozzle apertures in a spray nozzle casing wall. This sprinkler has proved very satisfactory in operation, particularly as the spray nozzle casing is also suitable for housing a swivel drive, with which the water curtain passing out of the spray nozzles can be swivelled backwards and forwards for sprinkling a corresponding large area.

SUMMARY OF THE INVENTION

An object of the invention is to provide a sprinkler of the aforementioned type, which makes it possible in a simple manner and with a compact construction, to limit the water distributor within relatively narrow limits to precisely defined areas.

In the case of a sprinkler of the aforementioned type, this object is achieved according to the invention in that a separate main channel is associated with the spray nozzle casing for water distribution between a line connection and the spray nozzles and the internal cross-sections of the main channel are significantly smaller than those of the casing and with respect to which the remaining spray nozzle casing is preferably sealed or sealable, so that the casing in particular fulfils the function of a support profile or casing, e.g. for the main channel, the spray nozzles, etc. Due to the limited volume of its water distributor, the sprinkler weight can be kept very low in operation and when the sprinkler is put into operation, i.e. when the supply of water starts, the pressure build up at the spray nozzles takes place very rapidly or substantially instantaneously, because there is no need beforehand to firstly fill the complete casing with water and to vent through the spray nozzles.

Another advantage is that the relatively narrow main channel can be sealed much more simply against an undesired water outflow than a relatively large-volume casing, particularly as the flow cross-section of the main channel, at least at its narrowest points, can be of the same order of magnitude as that of the connection for the water conduit or pipe, or can be even smaller than the latter.

In the longitudinal direction of the casing, at least one end of the main channel can project beyond the casing, at right angles to said longitudinal direction can be located at least partly outside the casing or completely on the outside of the casing and can at least partly be constructed in one piece with the casing. However, a particularly advantageous construction is obtained if the main channel is on the one hand formed by a separate, closed, installable subassembly and on the other hand is located substantially completely within the spray nozzle casing. If the main channel has the spray nozzles, e.g. in the sense that they belong to the said subassembly, then there is a further simplification to the water-tight seal.

As a result of the described construction, the swivel drive, which e.g. has a geared hydraulic motor connected to the water distributor, can be moved completely out of the latter as a separate component to the extent that water only flows over a clearly defined path through the motor or drive casing, but the water does not flow round it on its outside, so that the gear located within a separate drive casing does not operate in the water, but instead in a sealed gear chamber. A water outlet connection of the drive casing is directly connected to the main channel within the spray nozzle casing appropriately sealed by means of a connecting piece. As a result of the described, low operating rate of the swivellable part of the sprinkler, the easy operation of the swivel drive can be further improved.

In the case of a sprinkler of the aforementioned type, a further object of the invention is to be able to influence the guidance of the water on leaving the spray nozzle casing in such a way that it is possible to modify specific characteristics of the exiting water curtain, e.g. its width, density, etc.

According to the invention this object is achieved in that one or more spray nozzles can be switched off individually or groupwise at least partly and preferably completely with respect to the discharge of water, so that in operation little or no water flows from them. If the disconnectable or closable nozzles are provided at the front or rear end of the at least one spray nozzle row, then by disconnecting one or more of these end nozzles the width of the exiting water curtain can be effectively reduced for adapting to the size of the area to be sprinkled, particularly if said end nozzles are so outwardly inclined in fan-like manner, that the water curtain width is much larger than the nozzle row length.

In place of nozzle plugs or the like for closing the spray nozzles to be switched off, a particularly appropriate construction is obtained if each spray nozzle is closable with a separate valve substantially located within the spray nozzle casing and which can be operated as a simple slide valve by a linear movement roughly parallel to the exiting water curtain and/or at right angles to the casing axis.

If for water distribution purposes the described main channel is provided, then the disconnecting devices for the spray nozzles can belong to the subassembly of said main channel or their fixed parts can be constructed in one piece therewith.

For shutting off the particular spray nozzle appropriately a separate handle is provided, the handles for adjacent spray nozzles being successively located in the longitudinal direction of the nozzle row, while being directly accessible from the outside of the casing, so that in practice they form an indicator of the sprinkler setting state, because as a result of their position it is possible to recognize from a considerable distance the closed or open state of the associated spray nozzle.

These and other features of preferred further developments of the invention can be gathered from the claims, the description and drawings. The individual features can be realized singly or in the form of subcombinations in an embodiment of the invention and in other fields and represent advantageous, independently protectable constructions for which protection is hereby claimed.

BRIEF DESCRIPTION OF THE DRAWINGS

An embodiment of the invention is described in greater detail hereinafter relative to the drawings, wherein are shown.

DETAILED DESCRIPTION OF THE PREFERRED EMBODIMENTS

Figure 1:
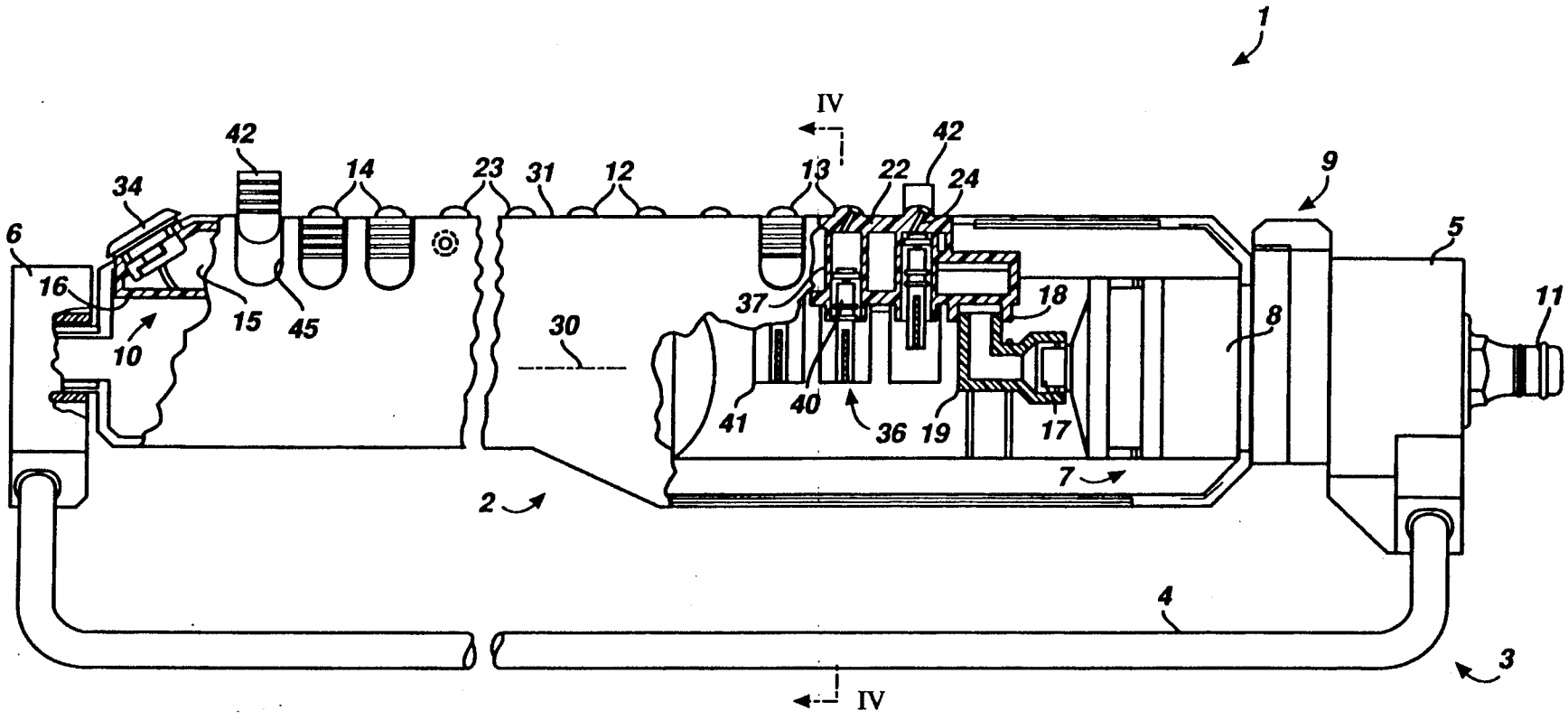
FIG. 1: an inventive sprinkler in part sectional view.

The sprinkler 1 according to FIGS. 1 to 14 has a thin-walled, plastic, substantially two-part spray nozzle casing 2, whose length is much greater than its cross-sectional width and which between the end supports 5,6 of an upright member 3 or in the vicinity of its ends is mounted in pivotable or rotatable manner about an axis parallel to the standing plane and to its median longitudinal axis. The upright member 3 has downwardly diverging elements 4, which are fixed by their ends to supports 5,6.

For the alternating or reversing swivel drive of the spray nozzle casing 2 is provided a drive mechanism 7 located substantially in casing 2 or between the supports 5,6 and provided with a hydraulic motor 8, which is inserted in a receptacle in the rear end of the casing and positioned in the swivel axis. With the drive mechanism 7 is associated a changing device 9 for changing the swivel angle and the position of the swivel area with respect to a reference plane, the changing device 9 being manually adjustable by adjusting rings located between the rear end of casing 2 and the associated support 5.

For the connection of a line connection 11 with spray nozzles 12,13,14, the spray nozzle casing has a water distributor 10, which is provided substantially along the top of casing 2 at a distance above the swivel axis and whose internal cross-section both in the height direction and in the width direction is much smaller than the associated internal cross-section of casing 2. In the swivel axis on the side of the associated support 5 remote from the rear casing end, the line connection 11 is provided in the form of a plug coupling connection, to which can be connected in easily detachable manner a water hose with a corresponding counter-coupling piece. In a single row parallel to the swivel axis, the spray nozzles 12,13,14 are successively provided over most of the length of casing 2 on its top surface and in upwardly directed manner, in such a way that they are located in one axial plane of casing 2. The spray nozzles are oriented at different angles, particularly within the said plane and preferably the outermost nozzles located on the ends of the nozzle row are inclined in diverging manner with respect to one another or with respect to a transverse median plane of the nozzle row under the greatest angle of e.g. approximately 34°. This angle of inclination between the individual nozzles can decrease by identical angular amounts to approximately O° on approaching said median plane.

The main channel 15 of water distributor 10 from which the spray nozzles 12,13,14 are directly supplied with pressure water, is formed by a separate plastic channel box 16 inserted or hung in the spray nozzle casing 2 and which extends approximately from the front end of hydraulic motor 8 to the front end of casing 2 and is positively engaged therein, in such a way that both in and at right angles to its longitudinal direction it is positionally secured by plug connections only with respect to the casing 2 The casing of hydraulic motor 8 through which flows the entire water quantity supplied by line connection 11 is provided at its front end with a connecting piece-like, projecting water outlet connection 17 located in the swivel axis and above which is provided a connecting piece-like water inlet connection 18 of channel box 16 projecting downwards approximately at right angles thereto. The two connections are interconnected by an angular connecting bend 19, which is engaged in sealed manner on the outer circumference of the water outlet connection 17 and also in sealed manner in the water inlet connection 18 and can be secured by said plug connections only.

Figure 2:
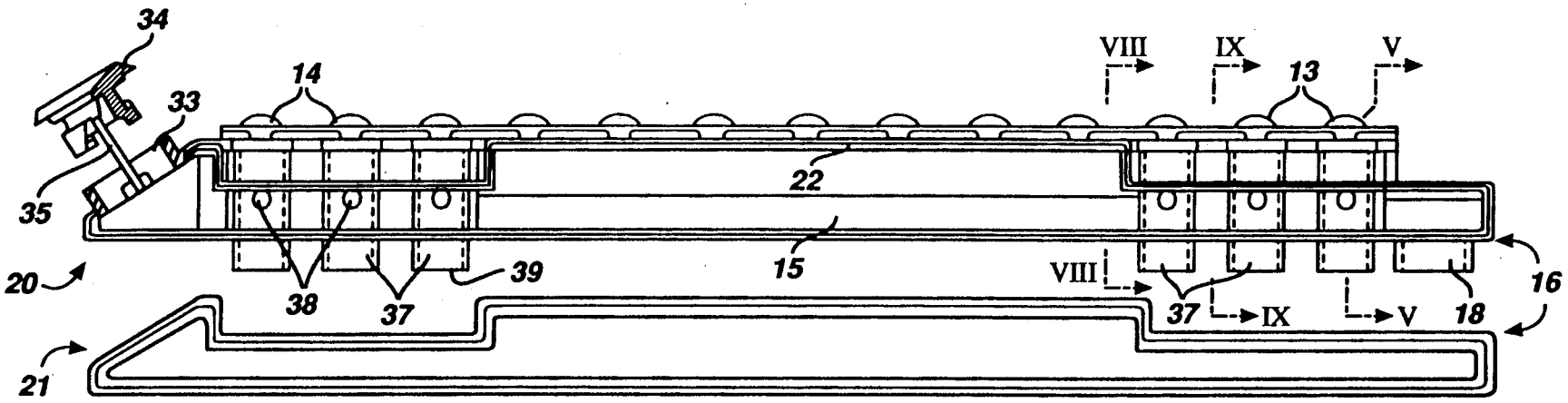
FIG. 2: the channel box of the sprinkler according to FIG. 1 in an opened side view.
Figure 3:
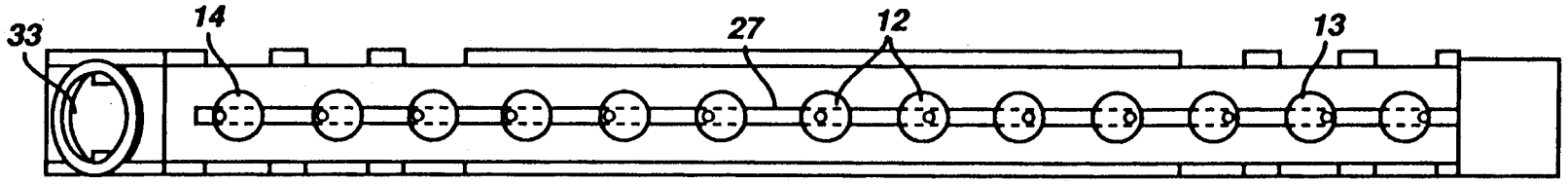
FIG. 3: the channel box according to FIG. 2 in plan view.
Figure 13:
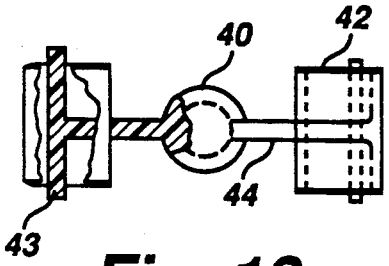
FIG. 13: the valve slide according to FIG. 11 in a part sectional plan view.
Figure 4:
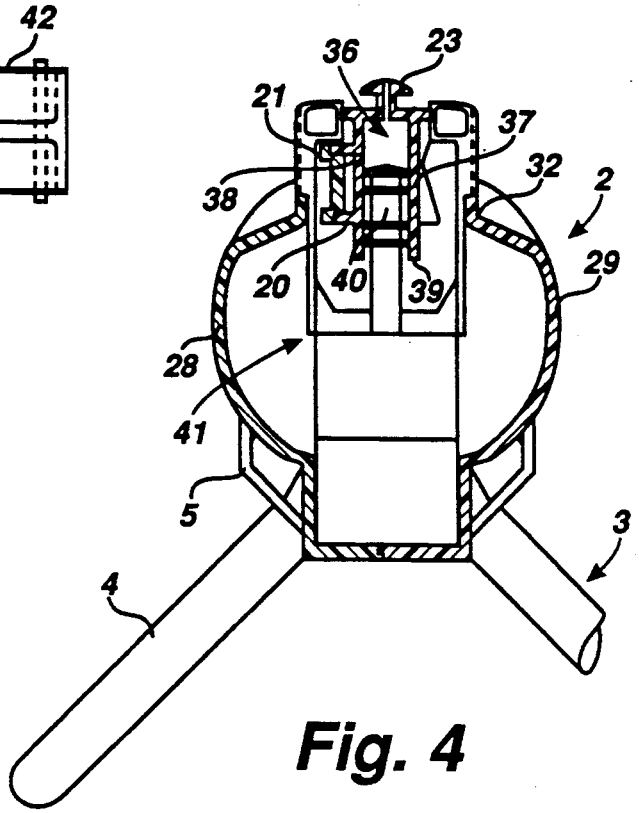
FIG. 4: a section along line IV—IV in FIG. 1.
Figure 12:
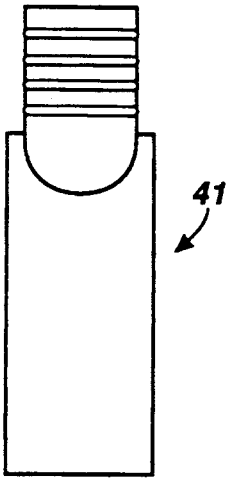
FIG. 12: the valve slide according to FIG. 11 in side view.
Figure 11:
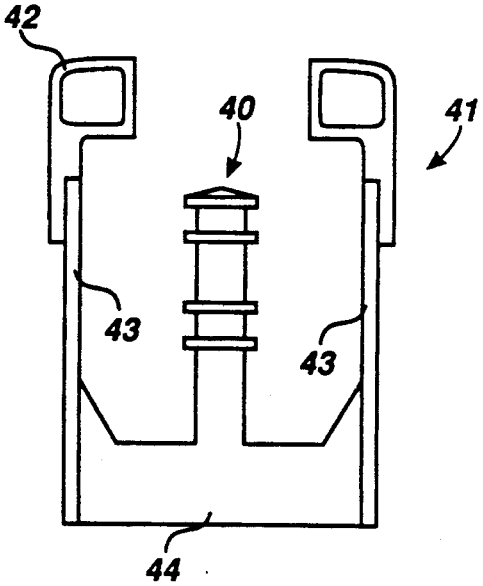
FIG. 11: a valve slide in a view according to FIG. 4 and on a larger scale.
Figure 5:
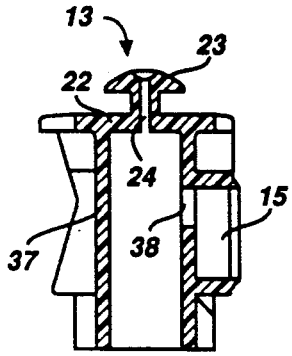
FIG. 5: a section approximately along line V—V in FIG. 2.
Figure 8:
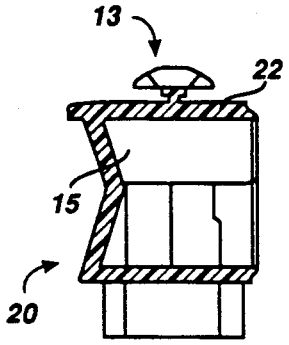
FIG. 8: a section along line VIII—VIII in FIG. 2.
Figure 9:
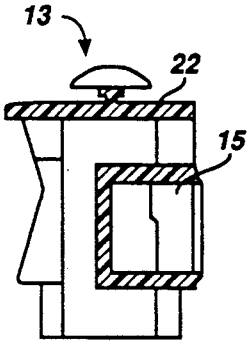
FIG. 9: a section along line IX—IX in FIG. 2.
Figure 10:
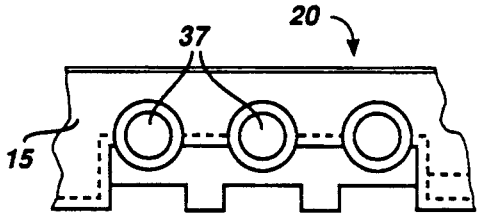
FIG. 10: a left-hand longitudinal portion of the channel box according to FIG. 2 in a view from below.
Figure 7:
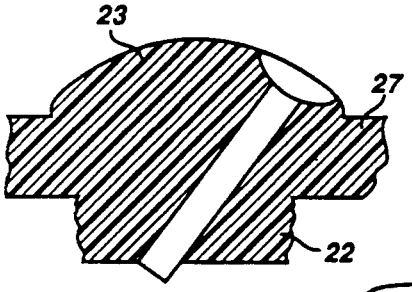
FIG. 7: the detail according to FIG. 6, but turned by 90°.
Figure 6:
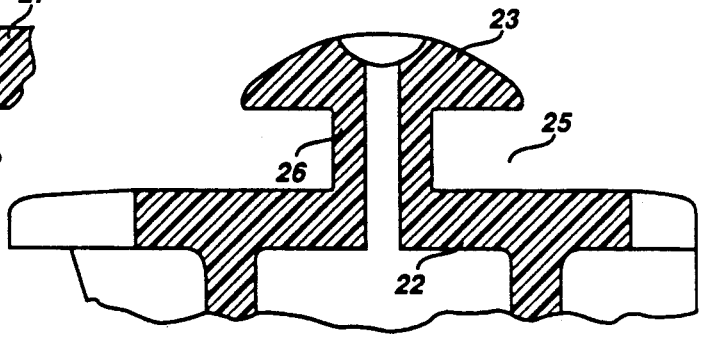
FIG. 6: a detail of FIG. 5 on a larger scale.
Figure 14:
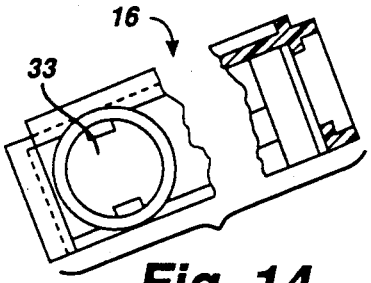
FIG. 14: a sloping plan view of the left-hand end of the channel box according to FIG. 2.

As can in particular be gathered from FIGS. 2 and 3, the channel box 16 is only formed by two components, namely an open box body 20 on one lateral longitudinal side and an approximately strip-like box cover 21, which engages in the open longitudinal side of box body 20 for closing the same and is e.g. fixed in sealed manner by ultrasonic welding. The box cover 21 extends substantially over the entire box body length. The box body 16 has essentially angular and in the areas adjacent to the main channel approximately rectangular cross-sections, so that as a result of the described construction, the box body 20 in said areas is cross-sectionally approximately horizontally U-shaped and box cover 21 is used for joining the U-legs.

The upper box wall 22 formed in the upper area of the nozzle row by the U-legs of the box body 20 is constructed in one piece with mushroom-like projecting nozzle heads 23, whereof each is traversed by a nozzle channel 24 aligned in the described manner and consequently forms one of the spray nozzles 12,13,14. Between the spherical segmental head portions of the nozzle heads 23 and the upper box wall 22 are provided on either side and laterally in said heads lateral slots 25 passing over the length of the nozzle row and whereof one lateral flank is formed by the top of the upper box wall 22 and whereof the other lateral flank is formed by the undersides of the spherical segmental head portions, so that the latter pass into the channel box 16 via shaft-like reduced portions 26. Portions 26, which are traversed by the nozzle channels 24, form intermediate portions of a longitudinal web 27 passing over the nozzle row and which extends over the width or height of the lateral grooves 25 and forms with the portions 26 a joint web.

The spray nozzle casing 2 comprises two substantially mirror symmetrical, complimentary casing shells 28,29, which in the axial plane of the casing axis coinciding with the nozzle plane are connected to one another with their facing wall edges and in the vicinity of the latter are joined together by ultrasonic welding or the like. The two casing shells 27,28 are not directly connected to one another in the vicinity of the nozzle row and are instead connected to one side of the longitudinal web 27, engaging in the lateral slots 25, so that the spherical segmental portions of the nozzle heads 23 form above the cover wall 29 of casing 2 projecting securing buttons engaging at the top over said cover wall with which the channel box 16 is suspended on the wall 31 of the spray nozzle casing 2.

The basic shape of the casing 2 is stepped over most of its length in an approximately cylindrical manner. In the rear area receiving the driving mechanism 7, the casing 2 forms a box-like region projecting over the cylindrical basic shape. In the vicinity of the nozzle row longitudinal depressions are provided in the cylindrical basic shape on either side thereof, the base walls of said longitudinal depressions passing into wall parts 32 projecting upwards over the cylindrical basic shape and which form the approximately planar cover wall 31, which is much narrower than the diameter of the cylindrical basic shape. This leads to the formation of two lateral, approximately parallel wall parts 32 on either side of the axial plane of the nozzle row and which are downwardly connected at an angle to the cover wall 31. The casing axis 30 located in the swivel axis essentially coincides with the central axis of the cylindrical basic shape.

At the front, bevelled end the channel box 16 is provided with a cleaning opening 33, which is bounded by a connection engaging in the cover wall of the spray nozzle casing 2 and which can be closed in an easily detachable manner by a cover 34 accessible from the outside. A nozzle needle 35 for cleaning the nozzle channels 24 can be provided on the inside of cover 34.

The three rearmost spray nozzles 13 and the three foremost spray nozzles 14 of the nozzle row can be connected and disconnected independently of one another by manual connection or disconnection with respect to the water distributor 10 or through the reduction of their inflow cross-section. For this purpose, for each of the spray nozzles 13 or 14 is provided a check valve 36 in the form of a slide valve, all the slide valves being parallel to one another and preferably in the common axial plane of the spray nozzle directly adjacent to the inner ends of the associated nozzle channels 24.

Equiaxial to nozzle head 23 of each disconnectible spray nozzle 13 or 14 is provided a pipe socket-like, cylindrical valve port 37 in each case located within the channel box 16 and which projects from the upper box wall 22 in one piece downwards over the bottom of the main channel 15 and is open at said lower end 39. Each valve port 37 passes through the main channel 15 in the vicinity of its longitudinal portion with its jacket, in such a way that said valve port 37 can merely be line-connected with main channel 15 in that its jacket is provided with a lateral inlet 38. In the vicinity of the check valves 36 or in the vicinity of the particular group of adjacent, disconnectible spray nozzles 13 or 14, the main channel 15 is cross-sectionally reduced by a step of the upper box wall 22, as well as by an arrangement laterally displaced with respect to the common axial plane of the spray nozzles, in accordance with FIGS. 5 and 9. The main channel and the particular valve port 37 are bounded and separated from one another in the associated area by a single, common partition, in which the lateral inlet 38 is provided.

From the lower, open end 39 is inserted in each valve port 37 a piston-like valve slide 40 carrying two axially spaced ring seals and which in its retracted, bottom end position frees the lateral inlet 38 and therefore its connection to the associated nozzle channel 24, whereas in its other end position e.g. striking against the inside of the upper box wall 22 it blocks the lateral inlet 38 and therefore the valve port 37 with respect to the main channel 15. For this purpose the valve slide 40 is constructed in one piece with a handle 42, with which it forms a substantially U-shaped slide part 41 with upwardly directed U-legs 43 in a longitudinal view of casing 2.

The U-cross web 44 of said slide part 41 has the valve slide 40 freely projecting in the centre of its width and positioned between the U-legs 43, while the approximately parallel, plate-like, U-legs 43 form on their upper ends in each case a shaped-on individual handle 42 with remote gripping faces and upper pressure faces. The individual handles 42 engage in adapted recesses of wall parts 32, on whose insides are located the U-webs 43, so that the slide part 41 is guided in a precisely defined manner by this and by the valve slide 40. When the check valve 36 is in the open position according to fig. 4, the tops of the handle 42 also guided in lateral recesses of the upper box wall 32 are roughly flush with the top of the cover wall 31 of the spray nozzle casing 2. At least one inwardly directed individual handle 42 projecting over the inside of the associated U-leg 43 can strike against the top of the profile section of box body 20 forming the main channel 15.

For closing the associated spray nozzle handle 42 is moved upwards, as shown in FIG. 1 for the two last spray nozzles 13,14, so that it projects on either side of the associated nozzle head above the top of the spray nozzle casing 2, but the recess 45 provided for its engagement in the particular wall part 32 remains substantially closed, because said recess 45 is completely covered on the inside by the associated U-leg 43. Corresponding extensions of said recesses 45 in cover wall 31 and in the upper box wall 32 remain closed in each position through the individual handles 42.

We claim:

1. A sprinkler comprising:

a spray nozzle casing connectable to a water pipe and having a water duct for a flow of water to at least one spray nozzle provided thereon, said casing extending proximate said at least one spray nozzle, the water duct being formed by a main channel narrower than inner cross-sections of said casing and bounded by channel wall structure including a longitudinal channel wall traversed by at least one duct connection between said main channel and said at least one spray nozzle, the casing being constructed as a support casing for said main channel, and wherein, commonly with said longitudinal channel wall, said main channel is formed at least one channel component separate from said fixedly secured to said casing as a subassembly, said at least one spray nozzle being a member of said subassembly.

2. The sprinkler according to claim 1, wherein said casing envelopes said channel component and is substantially sealed with respect to said main channel.

3. The sprinkler according to claim 1, wherein said channel component is constructed as a channel box parallel to said casing and extending over most of a length extension of said casing.

4. The sprinkler according to claim 1, wherein said at least one spray nozzle is a part of said channel component, said at least one spray nozzle extending to an exterior of said casing.

5. The sprinkler according to claim 1, wherein between one and a plurality of spray nozzles is constructed integrally with the channel component, each single spray nozzle being provided by an individual nozzle head projecting from an outer side of said channel component to an exterior of said casing.

6. The sprinkler according to claim 1, wherein said main channel of said channel component is substantially entirely located within said casing, said at least one spray nozzle projecting to an exterior of said casing.

7. The sprinkler according to claim 1, wherein an end of said channel component substantially adjacent to a swivel driving mechanism is at a distance from an associated end of said casing.

8. The sprinkler according to claim 1, wherein a plurality of a row of disconnectable spray nozzles is located substantially in a plane, all of said spray nozzles being inclined from a center of said row towards an outside end.

9. The sprinkler according to claim 1, wherein said casing is constructed for a swivellable mounting on at least one support.

10. A sprinkler comprising:

a spray nozzle casing connectible to a water pipe and having a water duct for at least one spray nozzle provided thereon;

at least one said at least one spray nozzle being constructed so as to be disconnectable independently of at least one further spray nozzle by a closure member, wherein said closure member is a valve body of a control valve arranged upstream of said at least one spray nozzle.

11. A sprinkler according to claim 10, wherein at least one of units including at least one disconnectable spray nozzle and at least one control valve associated with said at least one spray nozzle is provided on a channel box supported by said casing.

12. The sprinkler according to claim 10, wherein at least one from a row of successive spray nozzles located at least at one row end is disconnectable independently of any other nozzle with a control valve passed by said water duct.

13. The sprinkler according to claim 10, wherein a plurality of a row of disconnectable spray nozzles is located substantially in a plane, all of said spray nozzles being inclined from a center of said row towards an outside end.

14. The sprinkler according to claim 10, wherein between a main channel constructed for connection to a water pipe and at least one spray nozzle is provided a manually operable control valve constructed as a slide valve continuously transferable between an open position and a closed position.

15. A sprinkler according to claim 10, wherein a disconnecting handle for disconnecting at least one disconnectable spray nozzle from a flow of water in said water duct has laterally spaced handle sections on either side adjacent to said spray nozzle, said handle being accessible from an outside of said casing.

16. A sprinkler comprising:

a spray nozzle casing connectible to a water pipe and having a water duct for at least one spray nozzle, in the vicinity of the at least one spray nozzle the water duct being formed by a main channel narrower than inner cross-sections of said casing, the casing being constructed as a support casing for said main channel, wherein said casing comprises two lateral casing shells having oppositely directed cover wall parts engaging below heads of at least one said at least one spray nozzle in the vicinity of lateral slots, said cover wall parts being connected on either side to a longitudinal web connecting the heads.

17. The sprinkler according to claim 16, wherein an end of said main channel is so set back with respect to a receptacle of said casing for a hydraulic drive means, that said casing shells are directly interconnected in the vicinity of a cover wall following onto said end of said main channel.

18. A sprinkler comprising:

a spray nozzle casing connectible to a water pipe and having a water duct for at least one spray nozzle provided thereon, said casing extending substantially in the vicinity of said at least one spray nozzle, the water duct in the vicinity of the at least one spray nozzle being formed by a main channel narrower than inner cross-sections of said casing, the casing being constructed as a support casing for said main channel, and wherein said main channel is formed by at least one channel component separate from and fixedly secured to said casing, wherein at least one of units, including at least one spray nozzle and at least one control valve associated with said at least one spray nozzle, is provided on a channel box supported by said casing, said at least one spray nozzle being disconnectable from the flow of water by said control valve.

19. The sprinkler according to claim 18, wherein a valve channel of said at least one control valve is positioned laterally outside a main channel, said main channel being laterally ductively connected to said valve channel.

20. A sprinkler comprising:

a spray nozzle casing connectable to a water pipe and having a water duct for at least one spray nozzle provided thereon;

at least one said at least one spray nozzle being constructed so as to be disconnectable independently of at least one further spray nozzle, and wherein at least one disconnectable spray nozzle is positioned at an end of a valve duct having a lateral inlet, said valve duct having an end remote from the spray nozzle, a valve slide being inserted in said end, said valve duct providing a socket and said valve slide providing a piston member.

21. A sprinkler comprising:

a spray nozzle casing connectible to a water pipe and having a water duct for at least one spray nozzle provided thereon;

at least one said at least one spray nozzle being constructed so as to be disconnectable independently of at least one further spray nozzle; and, a disconnecting handle for at least one disconnectible spray nozzle positioned laterally on either side adjacent to said spray nozzle, said handle being accessible from an outside of said casing, said handle being formed by legs of a U-shaped slide member having a valve slide projecting in a same direction as said legs on a U-cross-web.

22. A sprinkler comprising:

a spray nozzle casing connectible to a water pipe and having a water duct for at least one spray nozzle provided thereon, at least one said at least one spray nozzle being constructed so as to be disconnectable independently of at least one further said spray nozzle, wherein a disconnecting handle located in a recess of said casing and operating at least one disconnectable spray nozzle extends in an open position at most up to a top side of said casing, said handle projecting beyond said top side of said casing, said handle projecting beyond said top side and an associated spray nozzle in a closed position.

23. A sprinkler comprising:

a spray nozzle casing connectible to a water pipe and having a water duct for at least one spray nozzle provided thereon;

at least one said at least one spray nozzle being constructed so as to be disconnectable independently of at least one further spray nozzle by a closure member, wherein said closure member is a valve body of a control valve arranged upstream of said at least one spray nozzle, said casing being constructed for a swivel mounting on at least one support.

24. A sprinkler comprising:

a spray nozzle casing connectible to a water pipe and having a water duct for at least one spray nozzle provided thereon, said casing extending substantially in the vicinity of said at least one spray nozzle, the water duct in the vicinity of the at least one spray nozzle being formed by a main channel narrower than inner cross-sections of said casing, the casing being constructed as a support casing for said main channel, and wherein said main channel is formed by at least one channel component separate from and fixedly secured to said casing, wherein from said channel component substantially exclusively at least one said at least one spray nozzle penetrates and projects beyond a top side of said casing, said channel component engaging on an inside of a cover wall of said casing.

25. A sprinkler comprising:

a sprinkler comprising:

a spray nozzle casing connectible to a water pipe and having a water duct for at least one spray nozzle provided thereon, said casing extending substantially in the vicinity of said at least one spray nozzle, the water duct in the vicinity of the at least one spray nozzle being formed by a main channel narrower than inner cross-sections of said casing, the casing being constructed as a support casing for said main channel, and wherein said main channel is formed by at least one channel component separate from and fixedly secured to said casing, said channel component being substantially fixed to said casing by hanging attachment to a top wall and by at least one plug connection.

26. A sprinkler comprising:

a spray nozzle casing connectible to a water pipe and having a water duct for at least one spray nozzle provided thereon, said casing extending substantially in the vicinity of the at least one spray nozzle, the water duct in the vicinity of the at least one spray nozzle being formed by a main channel narrower than inner cross-sections of said casing, the casing being constructed as a support casing for said main channel, and wherein said main channel is formed by at least one channel component separate from and fixedly secured to said casing, at least one nozzle head forming a connecting head for bearingly securing said channel component, said head resting on a top side of said casing.

27. A sprinkler comprising:

a spray nozzle casing connectible to a water pipe and having a water duct for at least one spray nozzle provided thereon, said casing extending substantially in the vicinity of said at least one spray nozzle, the water duct in the vicinity of the at least one spray nozzle being formed by a main channel narrower than inner cross-sections of said casing, the casing being constructed as a support casing for said main channel, and wherein said main channel is formed by at least one channel component separate from and fixedly secured to said casing, a channel box forming the main channel being substantially formed by a box body open on a lateral longitudinal side and a box cover closing said open longitudinal side, said channel box having at a rear end a water inlet connecting constructed as a plug-in connection.

28. A sprinkler comprising:

a spray nozzle casing connectible to a water pipe and having a water duct for at least one spray nozzle provided thereon, said casing extending substantially in the vicinity of said at least one spray nozzle, the water duct in the vicinity of the at least one spray nozzle being formed by a main channel narrower than inner cross-sections of said casing, the casing being constructed as a support casing for said main channel, and wherein said main channel is formed by a least one channel component separate from and fixedly secured to said casing, at least one from a row of successive spray nozzles located at least one row end being disconnectable independently of any other nozzle with a control valve passed by said water duct.

29. A sprinkler comprising:

a spray nozzle casing connectible to a water pipe and having a water duct for at least one spray nozzle provided thereon, said casing extending substantially in the vicinity of said at least one spray nozzle, the water duct in the vicinity of the at least one spray nozzle being formed by a main channel narrower than inner cross-sections of said casing, the casing being constructed as a support casing for said main channel, and wherein said main channel is formed by at least one channel component separate from and fixedly secured to said casing, wherein, between a main channel constructed for connection to a water pipe and at least one spray nozzle, is provided a manually operable control valve constructed as a slide valve continuously transferable between an open position and a closed position.

30. A sprinkler comprising:

a spray nozzle casing connectible to a water pipe and having a water duct for a flow of water to at least one spray nozzle provided thereon, said casing extending substantially in the vicinity of said at least one spray nozzle, the water duct in the vicinity of the at least one spray nozzle being formed by a main channel narrower than inner cross-sections of said casing, the casing being constructed as a support casing for said main channel, and wherein said main channel is formed by at least one channel component separate from and fixedly secured to said casing, a disconnecting handle for disconnecting at least one disconnectable spray nozzle from the flow of water, said handle having laterally spaced handle sections on either side adjacent to said spray nozzle, said handle being accessible from an outside of said casing.

* * * * *

UNITED STATES PATENT AND TRADEMARK OFFICE

CERTIFICATE OF CORRECTION

PATENT NO. : 5,052,622

DATED : October 1, 1991

INVENTOR(S) : LINDERMEIR et al.

It is certified that error appears in the above-identified patent and that said Letters Patent is hereby corrected as shown below:

Column 6, line 66, after "formed" insert --by--.

line 67, replace "said" with --and--.

Column 9, line 18, delete "of said".

line 19, delete "casing; said handle projecting beyond said top side".

line 50, delete "a sprinkler comprising:"

Signed and Sealed this

First Day of June, 1993

*Attest:*

*Attesting Officer*

Michael K. Kirk

MICHAEL K. KIRK

*Acting Commissioner of Patents and Trademarks*